US006632045B1

(12) United States Patent
McCartney

(10) Patent No.: US 6,632,045 B1
(45) Date of Patent: Oct. 14, 2003

(54) VEHICLE WHEEL TOOTH

(75) Inventor: Neil McCartney, Stockport (GB)

(73) Assignee: Bernard McCartney Limited, Stockport (GB)

( * ) Notice: Subject to any disclaimer, the term of this patent is extended or adjusted under 35 U.S.C. 154(b) by 0 days.

(21) Appl. No.: 09/373,220

(22) Filed: Aug. 12, 1999

(30) Foreign Application Priority Data

Dec. 24, 1998 (GB) ..... 9828424

(51) Int. Cl.[7] ..... E01C 19/26; B22D 19/00; E02F 9/28; E02F 3/00

(52) U.S. Cl. ..... 404/72; 404/124; 164/99; 37/453; 37/460

(58) Field of Search ..... 404/72, 93, 121, 404/124, 128, 133.05; 249/56; 164/98, 99; 37/453, 460; 76/101.1, DIG. 3

(56) References Cited

U.S. PATENT DOCUMENTS

| | | | | | |
|---|---|---|---|---|---|
| 3,274,908 | A | * | 9/1966 | Grant et al. | 404/121 |
| 3,650,185 | A | * | 3/1972 | Takata | 404/121 |
| 3,718,170 | A | | 2/1973 | Caron et al. | 152/49 |
| 3,724,342 | A | | 4/1973 | Caron et al. | 94/50 PR |
| 3,817,645 | A | * | 6/1974 | Trainor et al. | 404/121 |
| 3,822,957 | A | | 7/1974 | Caron et al. | 404/121 |
| 3,922,106 | A | | 11/1975 | Caron et al. | 404/121 |
| 3,970,445 | A | * | 7/1976 | Gale et al. | 420/64 |
| 4,011,051 | A | * | 3/1977 | Helton et al. | 29/182 |
| 4,066,375 | A | | 1/1978 | Caron et al. | 404/121 |
| 4,101,318 | A | * | 7/1978 | Rudy | 75/240 |
| 4,530,620 | A | * | 7/1985 | McCartney | 404/121 |
| 4,667,543 | A | * | 5/1987 | Tsugaki et al. | 76/108.2 |
| 4,693,293 | A | * | 9/1987 | Yamamoto et al. | 164/99 |
| 4,750,792 | A | | 6/1988 | Caron et al. | 305/54 |
| 4,865,400 | A | | 9/1989 | Caron et al. | 305/54 |
| 4,919,566 | A | | 4/1990 | Caron et al. | 404/121 |
| 4,953,612 | A | * | 9/1990 | Sare et al. | 164/102 |

(List continued on next page.)

FOREIGN PATENT DOCUMENTS

| | | | |
|---|---|---|---|
| EP | 0824168 A1 | 2/1998 | E02D/3/026 |
| JP | 59-218255 | * 12/1984 | |

OTHER PUBLICATIONS

Caron Compactor Company, *General Product Guide*, Bulletin No. FL–06–96, pp. 1–9, Modesto, California, Jun., 1996.

OY Tanacorp Ltd., *Tana Roller Compaction*, F–Series Guide, 16 pages, Vaajakoski, Finland, Mar., 1998.

Finning Cat, *Your Partners in Waste*, Product Guide, pp. 1–16, Aberdeen, Scotland, undated.

Caterpillar, Inc., *Caterpillar Landfill Compactor Tip for Traction Applications*, PEHP5049, 1 page, 1996.

Caterpillar, Inc., Parts Competitive Bulletin, Caterpillar Parts Information, *Caterpillar® Compactor Plus Tip vs. Caron Tips*, 1 page, Apr. 1996.

Caron Compactor Company, *Product Comparison—Maximizer™ vs. Super Duty Oin–On*, Product Guide, 1 page, undated.

Compactor Wheel Technology Limited, *Driving Ahead into the 90's*, Product Guide, 4 pages, Sheffield, Great Britain, undated.

Terra Compactor Wheel Corp., *Product Guide—Terrain–Adaptive High Density Wheels*, 8 pages, undated.

*Primary Examiner*—Gary S. Hartmann
(74) *Attorney, Agent, or Firm*—Akin Gump Strauss Hauer & Feld, LLP

(57) ABSTRACT

A tooth for a land compactor vehicle wheel comprises a base and a wall extending upwardly from the periphery of the base towards a crest. The crest has a peripheral profile defined by the upper edge of the wall and the wall is shaped such that the crest face is generally "M" shaped.

12 Claims, 6 Drawing Sheets

U.S. PATENT DOCUMENTS

| | | | | | |
|---|---|---|---|---|---|
| 4,991,662 | A | | 2/1991 | Caron et al. | 172/701.1 |
| H946 | H | | 8/1991 | Lonn | 404/121 |
| 5,101,879 | A | * | 4/1992 | Beck et al. | 164/98 |
| 5,217,321 | A | | 6/1993 | Corcoran et al. | 404/121 |
| 5,217,322 | A | * | 6/1993 | Corcoran et al. | 404/121 |
| D379,630 | S | | 6/1997 | Brockway | D15/29 |
| 5,687,799 | A | | 11/1997 | Greenfield et al. | 172/540 |
| 5,743,033 | A | * | 4/1998 | Gegel | 37/460 |
| 5,967,242 | A | | 10/1999 | Caron et al. | 172/817 |
| 6,066,407 | A | * | 5/2000 | Getz | 428/683 |

* cited by examiner

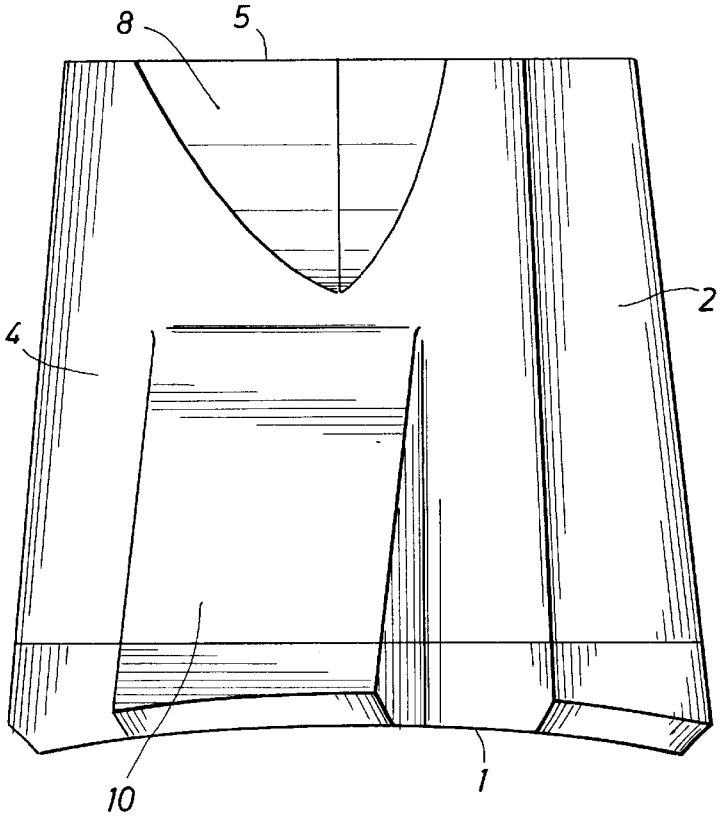
FIG. 3
FIG. 4
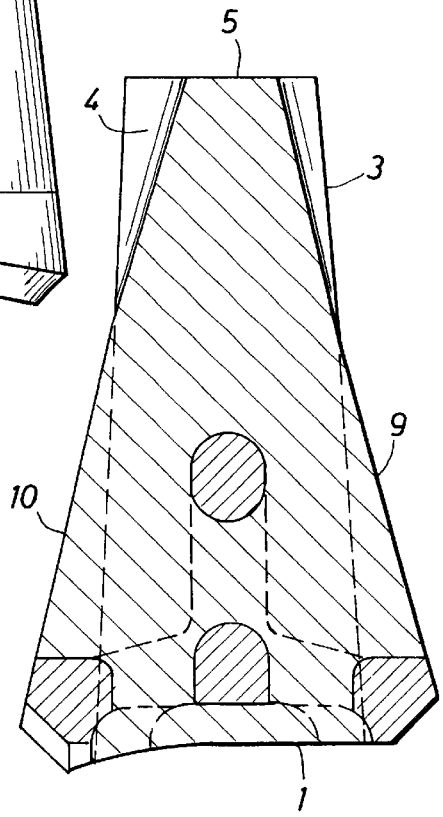
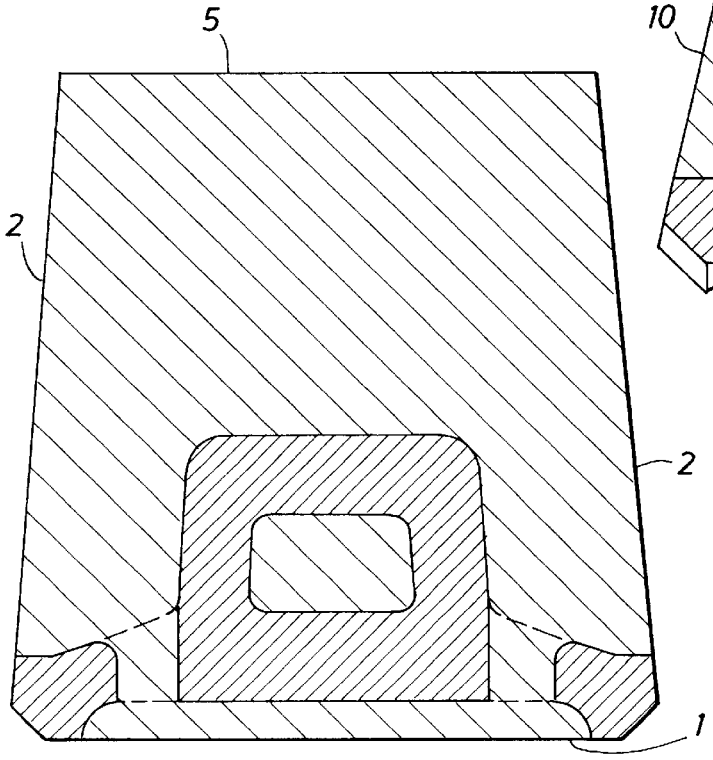
FIG. 5

FIG. 6
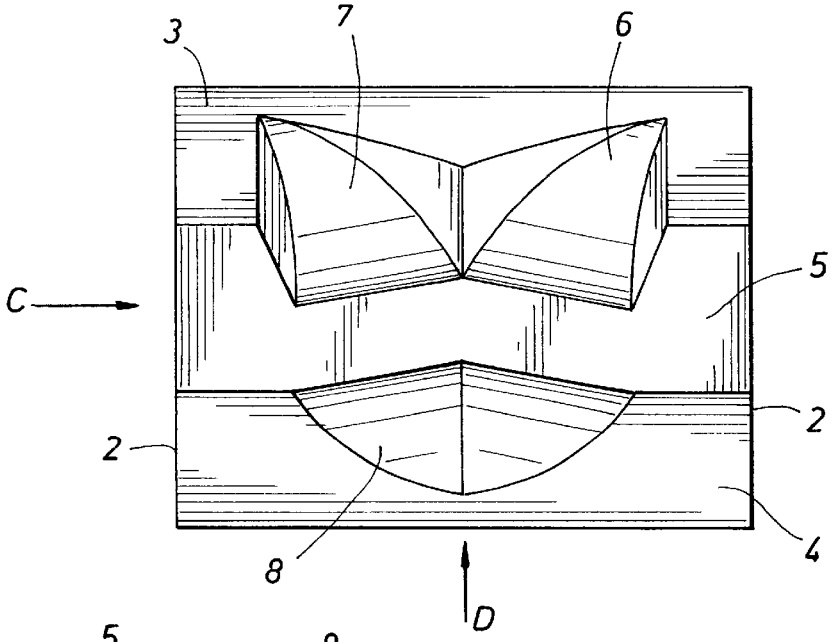
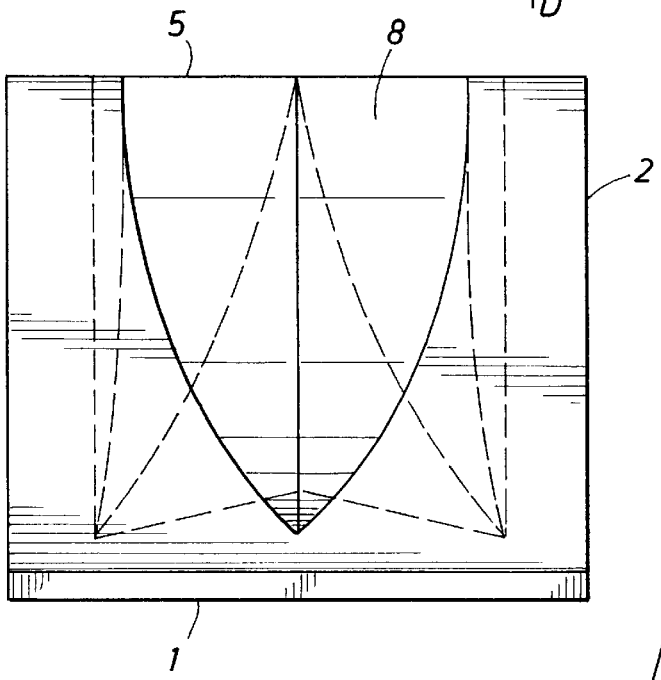
FIG. 8
FIG. 7
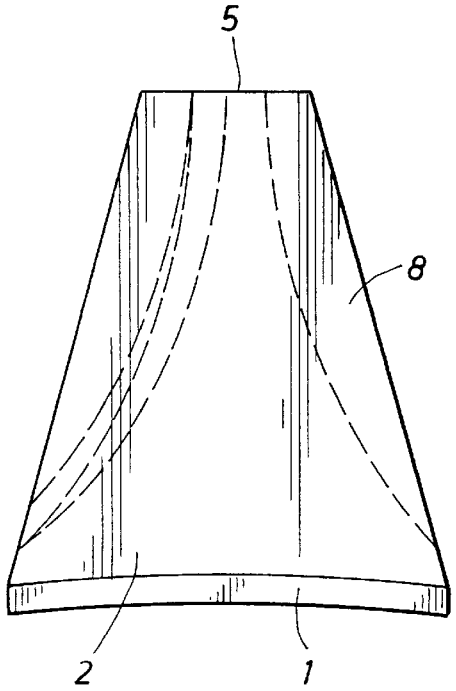

FIG. 13
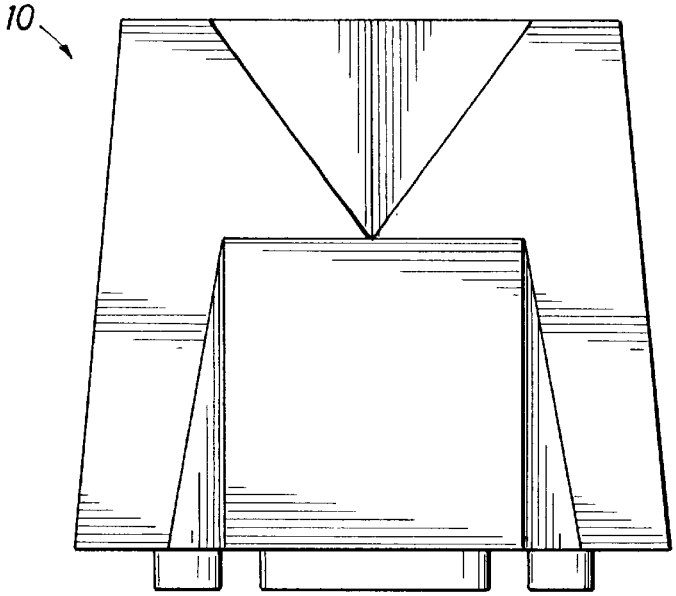
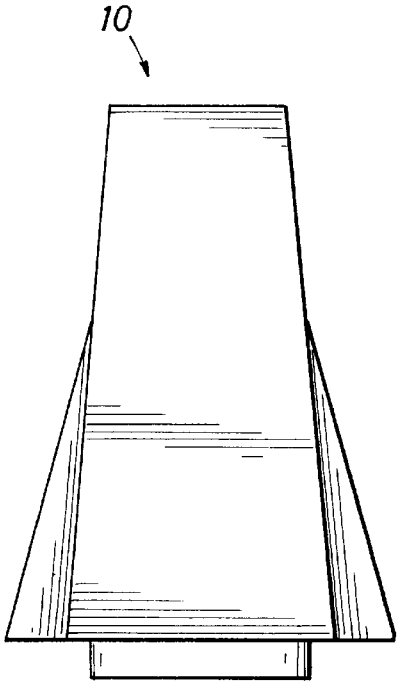
FIG. 14
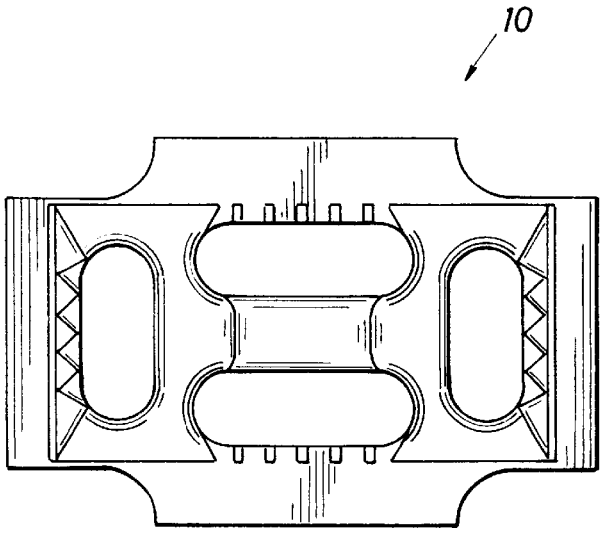
FIG. 15

VEHICLE WHEEL TOOTH

CROSS-REFERENCE TO RELATED APPLICATION

Priority is claimed to British Patent Application No. 9828424.3, filed Dec. 24, 1998.

FIELD OF THE INVENTION

This invention relates to a tooth for a vehicle wheel. In particular, the invention relates to an improved tooth design for a landfill compactor vehicle wheel.

BACKGROUND OF THE INVENTION

Large steel-wheeled vehicles, generally referred to as landfill compactor vehicles, are conventionally used to compact waste materials disposed of in landfill sites. Such vehicles have large toothed wheels (typically having a diameter of the order of 4 ft to 5.5 ft) which provide both traction for the vehicle and a means for breaking up and compacting the waste material.

The design of conventional landfill compactor vehicle wheels, and in particular the wheel teeth (which in many cases are removable so that they may be replaced when worn out) varies widely. With conventional tooth designs there can be a tendency for the compactor vehicle wheels to "flick and fluff" the tipping face of the landfill site. In other words, rather than being compacted into the surface, some relatively light materials can break away from the service and be disbursed by the wind which is clearly undesirable. One way of combating this problem is to import a cover which is spread on the face of the site. The problem has, however, increased in recent years with the introduction of Landfill Tax in the UK which has reduced the amount of heavy materials being disposed of in landfill sites. This has brought about a corresponding increase in wind-blown litter and/or an increase in the amount of cover material needed to combat the problem.

SUMMARY OF THE INVENTION

It is an object of the present invention to obviate or mitigate the above problem. The present invention achieves this by the provision of an improved vehicle tooth design.

It is a further object of the invention to provide a new method of manufacturing a vehicle wheel tooth.

According to a first aspect of the present invention there is provided a vehicle wheel tooth comprising a base, a wall extending upwardly from the periphery of the base towards a crest, the crest having a peripheral profile defined by the upper edge of the wall, wherein the wall is shaped such that the crest face is generally "M" shaped.

Preferably the wall is shaped by three depressions each defining a generally "V" or "U" shaped indentation in the peripheral profile of the crest face. Each of said depressions defines a channel in the wall of the tooth which extends from the crest towards the base, the channels mutually diverging. The channels preferably become both shallower and narrower towards the base of the tooth.

The tooth may for instance be shaped such that in the absence of said depressions the crest would have a generally rectangular peripheral profile with two opposing side edges.

In preferred embodiments of the tooth the base is generally rectangular having opposing front and rear edges and two opposing side edges shorter than said front and rear edges, wherein said wall comprises four faces (which are preferably mutually inclined) extending upwardly from respective base edges towards said crest.

According to a second aspect of the present invention there is provided a method of manufacturing a vehicle wheel tooth, the method comprising:

i) casting a base for the tooth by pouring a molten metal or metal alloy of a first type into a mold which defines the desired configuration of a base for the tooth;

ii) removing the base from the first mold and placing the pre-cast base in a second mold which defines the desired configuration of a cap for the tooth;

iii) pouring a molten metal or metal alloy of a second type into said second mold to cast the cap directly on to the pre-cast base.

According to a third aspect of the present invention there is provided a vehicle wheel tooth comprising a pre-cast base cast from a metal or metal alloy of a first type, and a cap cast directly onto the pre-cast base from a metal or metal alloy of a second type, the base and cap being keyed together.

BRIEF DESCRIPTION OF THE FIGURES

Specific embodiments of the present invention will now be described, by way of example only, with reference to the accompanying drawings, in which:

FIG. 3 is a side view of the tooth of FIG. 1 looking in the direction of arrow X of FIG. 1;

FIG. 4 is a cross-section through the tooth of FIG. 1 taken on the line 4—4;

FIG. 5 is a cross-section through the tooth of FIG. 1 taken on the line 5—5;

FIG. 6 is a plan view of a tooth in accordance with a second embodiment of the present invention;

FIG. 7 is a side view of the tooth of FIG. 6 looking in the direction of arrow C of FIG. 6;

FIG. 8 is an end view of the tooth of FIG. 6 looking in the direction of arrow D of FIG. 6;

FIG. 13 is a side view of the cap of FIG. 12 looking in the direction of arrow G of FIG. 12;

FIG. 14 is an end view of the cap of FIG. 12 looking in the direction of arrow H of FIG. 12; and FIG. 15 is an underneath view of the cap of FIG. 12.

DETAILED DESCRIPTION

Figure 1:
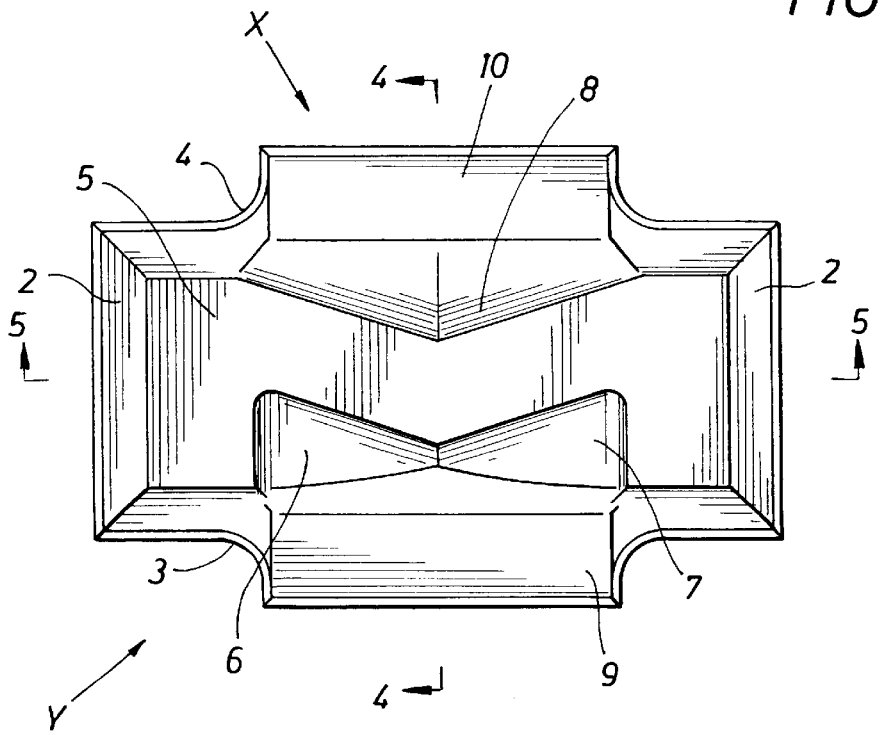
FIG. 1 is a plan view from above of a tooth in accordance with a first embodiment of the present invention.
Figure 2:
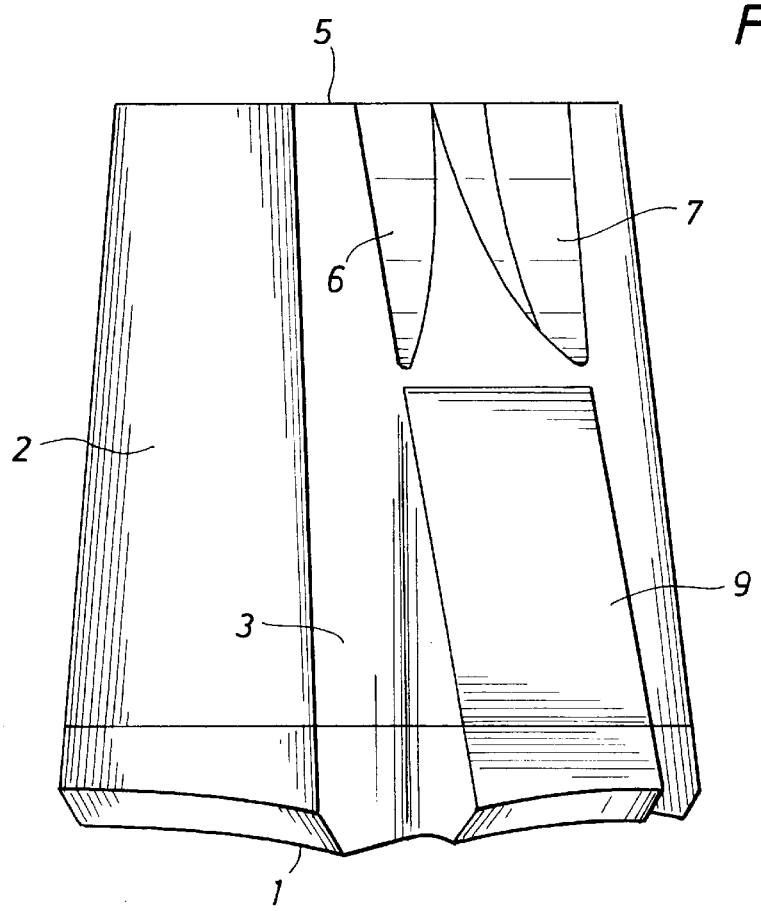
FIG. 2 is a side view of the tooth of FIG. 1 looking in the direction of arrow Y of FIG. 1.

Referring to the drawings, the illustrated teeth are designed for fitting to a land fill compactor vehicle wheel. Only details of the tooth necessary for an understanding of the present invention will be described and thus there will be no description of other details of a land fill vehicle or of a land fill vehicle wheel.

Referring first to FIGS. 1 to 5, the illustrated tooth comprises a generally rectangular base 1 which is adapted for welding to a steel wheel in a conventional way, and a cap 10. The cap 10 has two opposed side walls 2 and opposed front and rear walls 3 and 4 (having regard to the direction of rotation of the wheel) extend upwardly from respective edges of the base 1 and are mutually inclined towards a crest 5. The peripheral profile of the crest 5 is defined by upper edges of the walls 2, 3 and 4 and is described in more detail below.

The side walls 2 are identical and are trapezoid in shape tapering upwardly towards the crest 5. The angle of incline of the side walls 2 greatly reduces the tendency of the tooth to "flick and fluff" the tipping face. The angle of incline is selected relative to the angle of repose at which aggregates, when graded, settle in the tipping surface. Walls 3 and 4 are also generally trapezoid in shape but are provided with various contours defined by scallops 6, 7 and 8 and by ramped portions 9 and 10.

Scallops 6 and 7 are formed side by side in an upper portion of end wall 3 and cut into the crest face 5 so as to define a generally W shaped indentation in the peripheral profile of the crest face 5. The lower ends of the scallops 6 and 7 terminate short of the base, immediately above the ramp portion 9. Scallop 8 is formed in an upper portion of the opposing rear wall 4 and terminates immediately above the ramp portion 10. The scallop forms a generally V shaped indentation in the peripheral profile of the crest face 5 of substantially the same width as the W shaped indention formed by scallops 6 and 7. The depressions formed in the rear wall 4 by the scallops 6, 7 and 8 become narrower and shallower towards the base and the scallops 6 and 7 curve away from one another.

It will thus be seen that the provision of the scallops 6, 7 and 8 gives the crest face 5 a generally M shaped profile, the scallops 6, 7 and 8 forming channels in the walls 3 and 4 which extend from the crest face 5 part way towards the base.

In use, the channels provided by the scallops 6, 7 and 8 provide an advantageous effect on the action of the tooth as the wheel travels over a land fill site surface. That is, waste material is directed and compressed in three diverging directions. Thus, each time a tooth impacts upon the surface it exerts a three-way splitting and compressing action on the material which reduces the particle size of the waste and makes it much less likely for the waste to be carried away by the wind. The compression also minimizes oxygen voids thereby saving air space and increasing compaction.

It will be appreciated that modifications may be made to the tooth design described above. One such possible modification is shown in FIGS. 6 to 8. Various features of the illustrated design are identified by reference numerals corresponding to those above. It will thus be appreciated that the design is very similar to that described above. The most significant differences are that the side walls 2 are not inclined and the ramp portions 9 and 10 are omitted, the scallops 6, 7 and 8 extending further towards the base of the tooth.

Other possible modifications will be apparent to the appropriately skilled person.

As mentioned above, the base 1 of the tooth is adapted to be welded to a steel wheel and therefore must be constructed from a weldable metal. However, such weldable metals are not generally sufficiently hard to withstand the abrasive wear to which the tooth will in use be subjected. Thus, with preferred teeth according to the present invention, such as those described above, a harder metal (such as a chromium iron alloy) is used for the cap 10 than for the base 1. It would not be practical to construct the whole tooth from such a hard metal as such metals are not readily weldable.

The preferred method of manufacturing such a "two-part" tooth in accordance with the present invention will now be described with reference to FIGS. 9 to 15 which illustrate separately the base 1 and cap 10 of a tooth which is very similar to those described above (and thus like reference numerals are used for like features).

Figure 9:
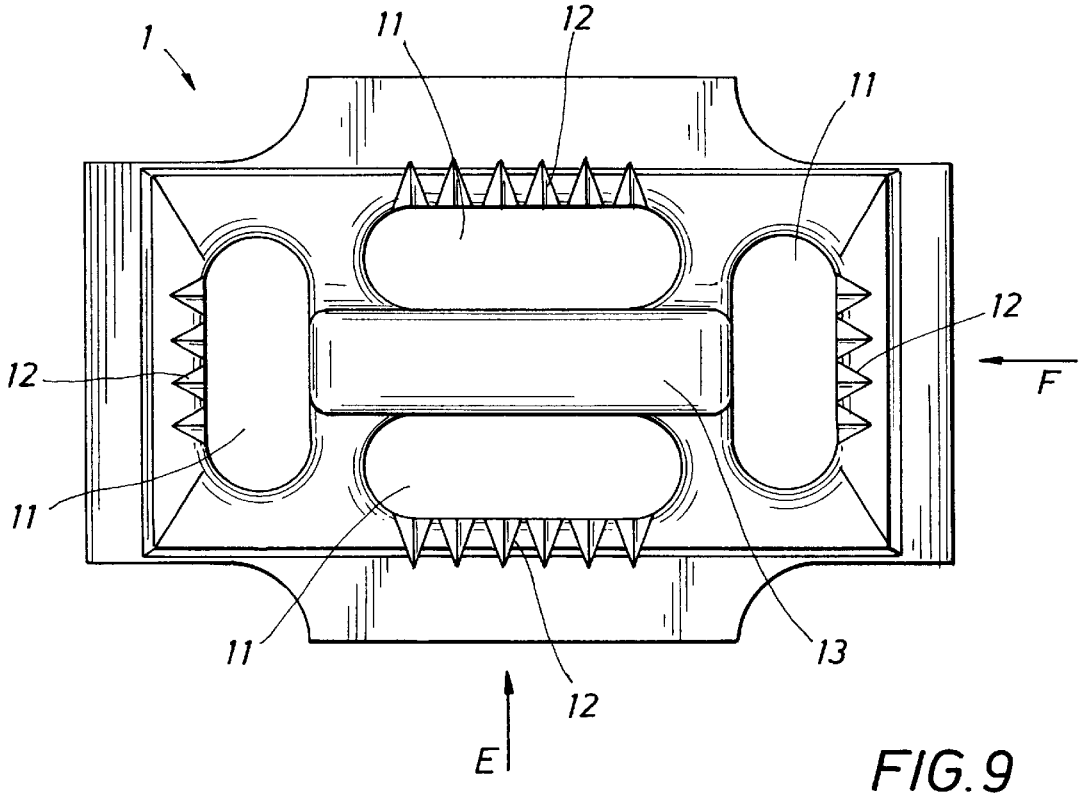
FIG. 9 is a plan view from above of a base for a tooth in accordance with a third embodiment of the present invention.
Figure 10:
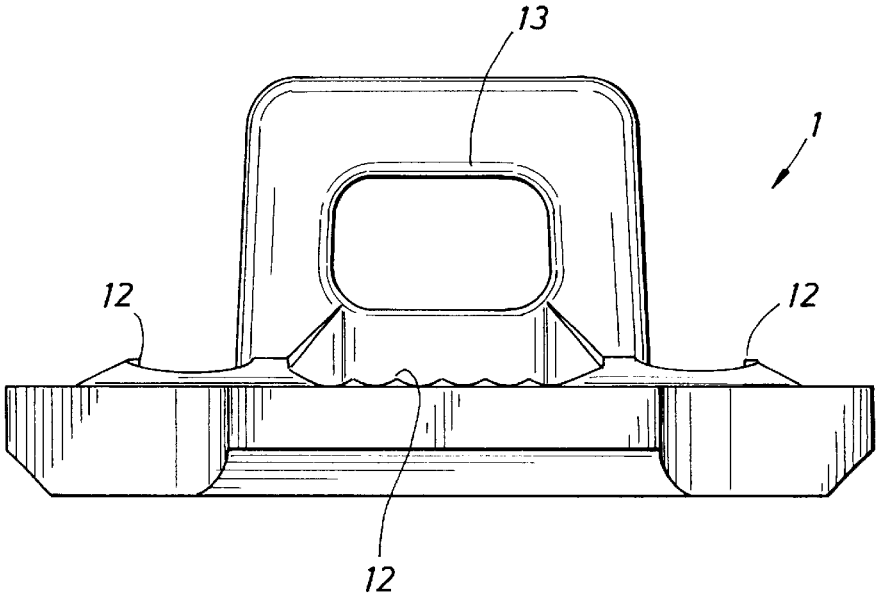
FIG. 10 is a side view of the tooth base of FIG. 9 looking in the direction of arrow E of FIG. 9.
Figure 11:
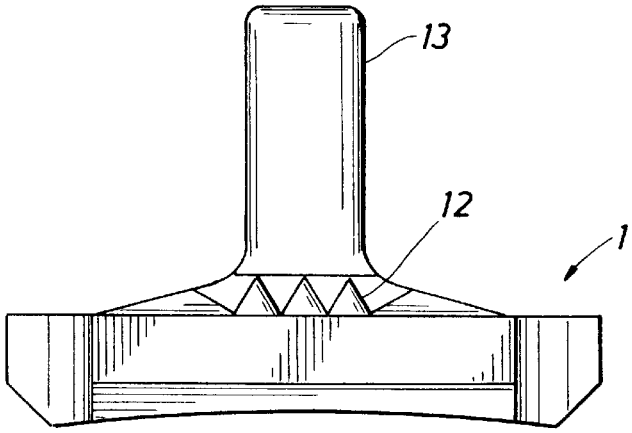
FIG. 11 is an end view of the base of FIG. 9 looking in the direction of arrow F of FIG. 9.
Figure 12:
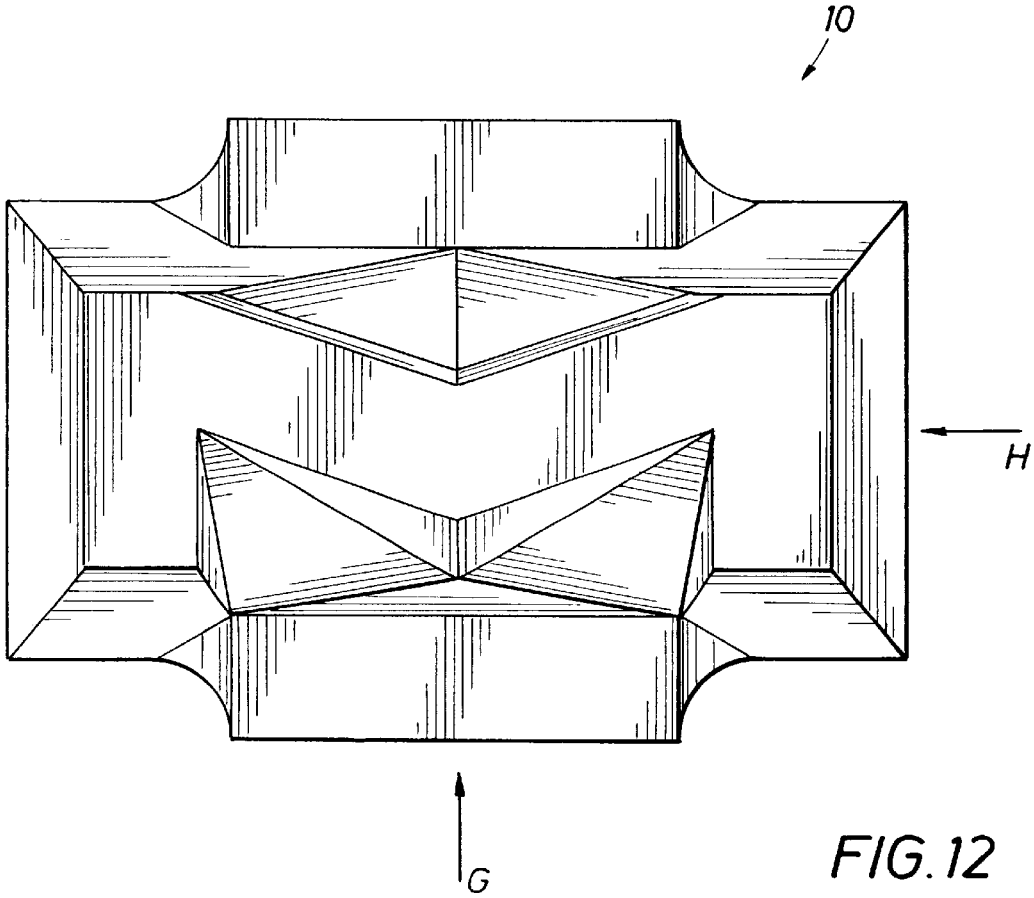
FIG. 12 is a plan view of a cap of the tooth in accordance with the third embodiment of the present invention.

The tooth base 1, which is illustrated in FIGS. 9, 10 and 11, is cast in a first mold from a weldable metal, such as a carbon steel, using conventional casting techniques. The pre-cast base 1 is then placed into a second mold shaped according to the desired cap 10. The cap 10 is then cast directly onto the base by pouring a molten metal (such as a chromium iron alloy) into the second mold onto the pre-cast base 1. The cap 10 then solidifies around the base 1 to give the completed tooth.

The base 1 is designed with a number of mating formations into which the molten cap metal flows to ensure that when the cap solidifies the cap 10 and base 1 are firmly keyed together. The particular mating formations of the illustrated base 1 are the recesses 11, crenulations 12 and the apertured portion 13.

The casting conditions of the cap 10 must be controlled to avoid melting away the mating formations of the base 1. The resulting cap 10 therefore has formations corresponding to the base formations as is illustrated in FIGS. 12 to 15. Although the cap 10 is shown separate from the base 1 it will be appreciated that the two are not separable once cast.

What is claimed is:

1. A method of manufacturing a vehicle wheel tooth, the method comprising:

casting a base for the tooth by pouring a first molten metal or metal alloy into a first mold which defines the desired configuration of a base for the tooth;

removing the base from the first mold and placing the base in a second mold which defines the desired configuration of a cap for the tooth;

pouring a second molten metal or metal alloy into the second mold to cast the cap directly on to the base, wherein the base is provided with formations which receive the second molten metal or metal alloy during the casting step such that the cap is keyed into the base.

2. The method according to claim 1, wherein the first molten metal or metal alloy is of a type which may be readily welded to a vehicle wheel tooth.

3. The method according to claim 2, wherein the first molten metal or metal alloy is a carbon based steel.

4. The method according to claim 1, wherein the second metal or metal alloy is of a type which is more resistant to abrasion than the first metal or metal alloy.

5. The method according to claim 4, wherein the second metal or metal alloy is a chromium iron alloy.

6. The method according to claim 1, wherein the formations include a raised portion which has an aperture extending therethrough.

7. The method according to claim 1, wherein the formations include indentations or cavities formed in a surface of the base.

8. A vehicle wheel tooth comprising:

a pre-cast base of a first metal or metal alloy, comprising a plurality of formations; and a cap of a second metal or metal alloy cast onto the pre-cast base, wherein the formations of the pre-cast base are adapted to receive the cap, firmly keying the pre-cast base and cap together.

9. The vehicle wheel tooth according to claim 8, wherein the first metal or metal alloy is readily weldable to a vehicle wheel.

10. The vehicle wheel tooth according to claim 8 or 9, wherein the second metal or metal alloy is harder and more resistant to abrasion than the first metal or metal alloy.

11. The vehicle wheel tooth of claim 8, wherein the formations comprise a raised portion which has an aperture extending therethrough.

12. The vehicle wheel tooth of claim 8, wherein the formations include indentations or cavities formed in a surface of the pre-cast base.

* * * * *